US011002103B2

(12) United States Patent
Vasques

(10) Patent No.: US 11,002,103 B2
(45) Date of Patent: May 11, 2021

(54) DOWNHOLE SYSTEM WITH SLIDING SLEEVE

(71) Applicant: Welltec Oilfield Solutions AG, Zug (CH)

(72) Inventor: Ricardo Reves Vasques, Zug (CH)

(73) Assignee: Welltec Oilfield Solutions AG, Zug (CH)

( * ) Notice: Subject to any disclaimer, the term of this patent is extended or adjusted under 35 U.S.C. 154(b) by 175 days.

(21) Appl. No.: 16/270,035

(22) Filed: Feb. 7, 2019

(65) Prior Publication Data

US 2019/0242211 A1 Aug. 8, 2019

(30) Foreign Application Priority Data

Feb. 8, 2018 (EP) ..... 18155899

(51) Int. Cl.

| | |
|---|---|
| ***E21B 33/128*** | (2006.01) |
| ***E21B 34/10*** | (2006.01) |
| ***E21B 34/14*** | (2006.01) |
| ***E21B 34/06*** | (2006.01) |

(52) U.S. Cl.

CPC ..... *E21B 33/1285* (2013.01); *E21B 34/06* (2013.01); *E21B 34/101* (2013.01); *E21B 34/14* (2013.01); *E21B 2200/06* (2020.05)

(58) Field of Classification Search

CPC .... E21B 33/1285; E21B 34/06; E21B 34/101; E21B 34/14; E21B 2200/06

See application file for complete search history.

(56) References Cited

U.S. PATENT DOCUMENTS

| | | | | |
|---|---|---|---|---|
| 3,211,232 | A | 10/1965 | Grimmer | |
| 5,316,084 | A | 5/1994 | Murray et al. | |
| 8,316,953 | B2 * | 11/2012 | Reid et al. | E21B 34/10 166/375 |
| 2005/0139362 | A1 * | 6/2005 | Coon et al. | E21B 33/12 166/386 |

(Continued)

FOREIGN PATENT DOCUMENTS

| | | |
|---|---|---|
| EP | 1 550 789 | 7/2005 |
| WO | 2015/102603 | 7/2015 |
| WO | 2016/133500 | 8/2016 |

OTHER PUBLICATIONS

Extended Search Report for EP18155899.0, dated Jul. 27, 2018, 9 pages.

*Primary Examiner* — Yong-Suk (Philip) Ro

(74) *Attorney, Agent, or Firm* — Nixon & Vanderhye P.C.

(57) ABSTRACT

A downhole system for completing a well includes a well tubular metal structure including an inside having an inside pressure, an opening and an axial extension, and a sliding sleeve movable along the axial extension between a first position in which the sliding sleeve seals off the opening and a second position in which fluid communication between the borehole and the inside of the well tubular metal structure is allowed. The sliding sleeve has a first sealing element arranged on one side of the opening and a second sealing element arranged on the other side of the opening in the first position A pressure reducing mechanism is arranged in relation to the first sealing element for reducing a pressure exerted on the first sealing element while moving the sliding sleeve from the first position to the second position.

18 Claims, 7 Drawing Sheets

(56) References Cited

U.S. PATENT DOCUMENTS

Figure 1:
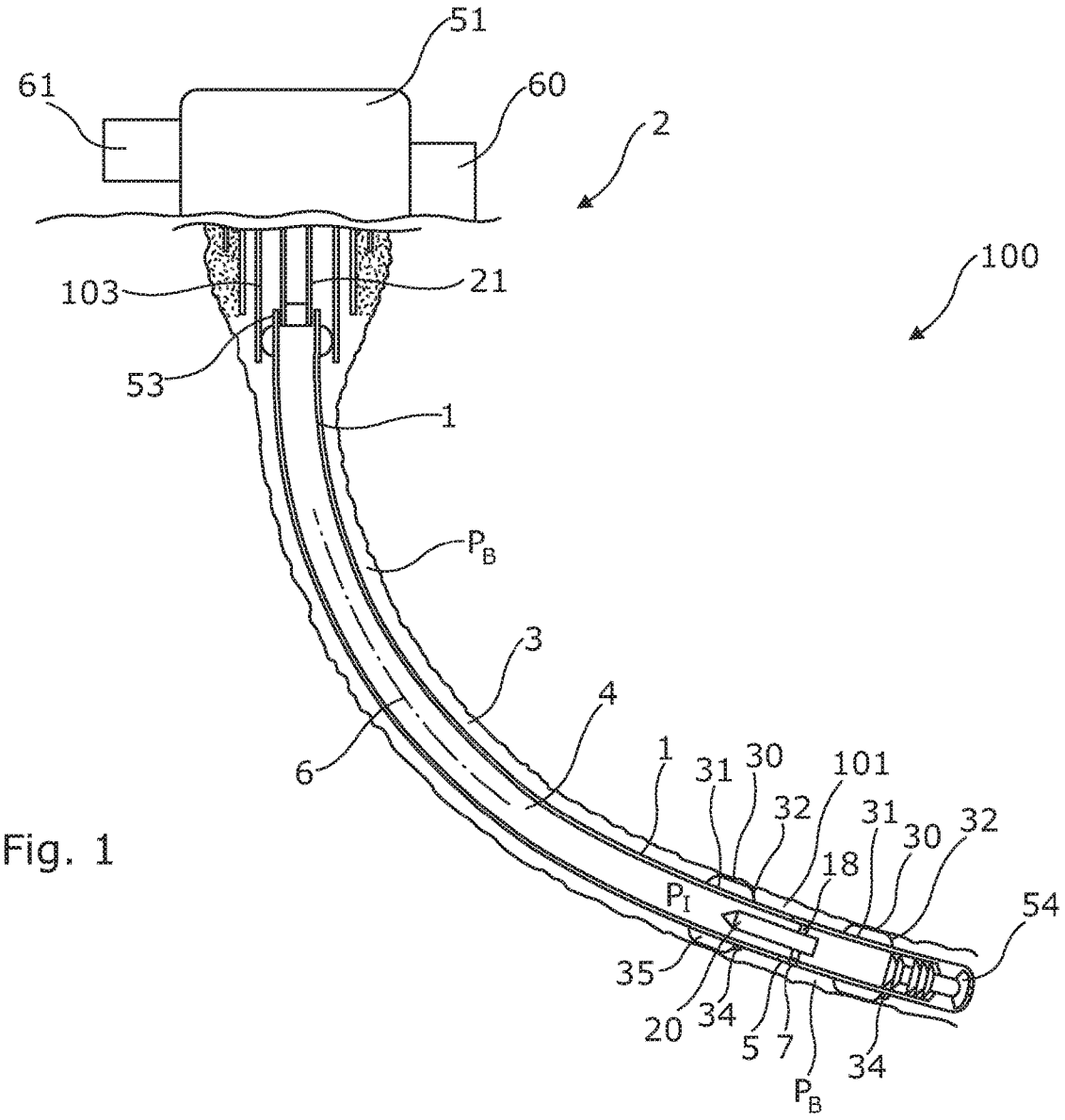

| | | | | |
|---|---|---|---|---|
| 2007/0144744 | A1 | 6/2007 | Wong | |
| 2016/0273304 | A1 * | 9/2016 | Vick, Jr. et al. | E21B 34/10 166/375 |

* cited by examiner

DOWNHOLE SYSTEM WITH SLIDING SLEEVE

This application claims priority to EP Patent Application No. 18155899.0 filed 8 Feb. 2018, the entire contents of which is hereby incorporated by reference.

The present invention relates to a downhole system for completing a well, comprising a well tubular metal structure arranged in a borehole having a borehole pressure, the well tubular metal structure comprising an inside having an inside pressure, an opening and an axial extension, and a sliding sleeve movable along the axial extension between a first position in which the sliding sleeve seals off the opening and a second position in which fluid communication between the borehole and the inside of the well tubular metal structure is allowed, the sliding sleeve comprising a first sealing element arranged on one side of the opening and a second sealing element arranged on the other side of the opening in the first position.

When operating a well, it is important that openings in the tubing may be properly sealed off either during the completion of the well or during the production. This closure is often performed by having a sliding sleeve in front of the opening, where the sliding sleeve comprises several sealing elements for enhancing the sealing property. Due to the harsh environment, the sealing elements are exposed to high temperatures and largely varying pressures as well as great pressure differences over the sealing elements. When moving the sliding sleeve a number of times between a first position in which the sliding sleeve seals off the opening and a second position in which fluid communication with the borehole is allowed, the sealing elements have been experienced to loose their sealing capabilities whereby the openings may not be properly sealed off.

It is an object of the present invention to wholly or partly overcome the above disadvantages and drawbacks of the prior art. More specifically, it is an object to provide an improved downhole system having a sliding sleeve which may be moved in relation to an opening without jeopardizing the sealing capabilities of the sliding sleeve.

The above objects, together with numerous other objects, advantages and features, which will become evident from the below description, are accomplished by a solution in accordance with the present invention by a downhole system for completing a well, comprising:

- a well tubular metal structure arranged in a borehole having a borehole pressure, the well tubular metal structure comprising an inner face and an inside having an inside pressure, an opening and an axial extension, and
- a sliding sleeve having an outer face and movable inside the well tubular structure and along the axial extension between a first position in which the sliding sleeve seals off the opening and a second position in which fluid communication between the borehole and the inside of the well tubular metal structure is allowed, the sliding sleeve comprising a first sealing element arranged on the outer face on one side of the opening and a second sealing element arranged on the outer face on the other side of the opening in the first position, wherein a pressure reducing mechanism is arranged in relation to the first sealing element for reducing a pressure exerted on the first sealing element while moving the sliding sleeve from the first position to the second position, and wherein the pressure reducing mechanism is a labyrinth seal.

By having the pressure reducing mechanism comprising a labyrinth seal, the high pressure is reduced before acting on the first sealing element, and thus the first sealing element is not exposed to the high pressure difference when opening the sliding sleeve, i.e. moving from the first position to the second position.

Furthermore, by having the first sealing element and the second sealing element arranged on the outer face of the sliding sleeve, the sealing elements move along with the sliding sleeve and are not left behind exposed to the risk of falling radially inwards or being ripped off by the well fluid during production. When having the sealing elements moving along with the sliding sleeve, the sealing elements are arranged between the inner face of the well tubular metal structure of the outer face of the sliding sleeve during production or fracking and not exposed to the "dirty" well fluid and high pressure. Also, the sealing elements, when arranged around the sliding sleeve, are provided with a slight pre-tension enabling the sealing elements to be maintained in the predetermined position and not as in prior art solutions bulge inwards to a groove in the sliding sleeve resulting in an unintended off-set position where the sealing elements are in the stationary well tubular metal structure.

Moreover, the sliding sleeve may have the outer face having at least two grooves and facing the inner face of the well tubular metal structure, the first sealing element is arranged in one of the grooves and the second sealing element is arranged in the other of the grooves.

In addition, a distance between the outer face of the sliding sleeve and the inner face of the well tubular metal structure may be less than a distance from which the sealing element projects radially from the outer face of the sliding sleeve.

Furthermore, an inner diameter of the sealing elements may be less than an outer diameter of a part of the outer face of the sliding sleeve so as to provide the sealing elements with a pre-tension when arranged on that part of the outer face.

Moreover, the sloping part may form part of an indentation or groove in the well tubular metal structure.

Also, the indentation may end in the opening.

Furthermore, the indentation may have a tapering part furthest away from the opening.

In addition, the inside pressure may be substantially larger than the borehole pressure.

Also, the pressure reducing mechanism may reduce the inside pressure exerted on the first sealing element.

Moreover, the first sealing element and the second sealing element may be arranged on the same side of the opening in the second position.

Furthermore, the well tubular metal structure may have a recess in which the sliding sleeve moves between the first position and the second position.

Also, the pressure reducing mechanism may be arranged between the opening and the first sealing element in the first position.

In addition, at least the first sealing element may comprise a first element part and a second element part, where the second element part is made of a material more rigid than that of the first element part.

Furthermore, at least the first sealing element may further comprise a third element part arranged in a groove in the first element part facing the outer face so that the third element part may energies the first element part.

Also, the sliding sleeve may comprise a second labyrinth seal.

Moreover, the pressure reducing mechanism may be at least one slit penetrating the well tubular metal structure and extending in the axial extension from the opening towards the first sealing element in the first position.

In addition, the slit may form part of the opening.

Also, the pressure reducing mechanism may comprise a check valve arranged in a through-bore of the sliding sleeve; and a sloping part being provided in the well tubular metal structure and being in fluid communication with the opening so that the check valve moves from a closed position to an open position when the check valve is opposite the sloping part allowing fluid from the inside to the borehole.

Furthermore, the first sealing element may be arranged between the pressure reducing mechanism and the opening in the first position which creates an annular volume between the well tubular metal structure, the sliding sleeve, the first sealing element and the pressure reducing mechanism.

The pressure reducing mechanism may be a labyrinth seal.

Also, the well tubular metal structure may comprise more than one opening provided around the circumference of the well tubular metal structure.

Moreover, the well tubular metal structure may comprise more than one opening provided at a distance from each other along the axial extension, a sliding sleeve moving opposite each opening.

In addition, the downhole system may further comprise an engaging element for engaging a profile in the sliding sleeve and for moving the sliding sleeve between the first and the second position, the engaging elements being parts of an intervention tool or an inner well tubular metal structure.

Furthermore, the downhole system may further comprise a third sealing element arranged between the pressure reducing mechanism and the opening in the first position.

The first sealing element and second sealing element may be chevron seals.

The downhole system may further comprise an annular barrier having a tubular part to be mounted as part of the well tubular metal structure, the tubular part is surrounded by an expandable metal sleeve, the expandable metal sleeve is configured to be expanded by means of pressurised fluid from the inside of the well tubular metal structure through a valve assembly into an annular space between the tubular part and the expandable metal sleeve.

In addition, a first annular barrier and a second annular barrier may together isolate a production zone between them.

Moreover, a plurality of annular barriers may be configured to isolate a plurality of zones along the axial extension.

The opening and the sliding sleeve may be arranged opposite the production zone.

The downhole system may further comprise a plurality of openings arranged with a distance along the axial extension and a plurality of sliding sleeves, each sliding sleeve arranged opposite one of the openings.

Figure 2A:
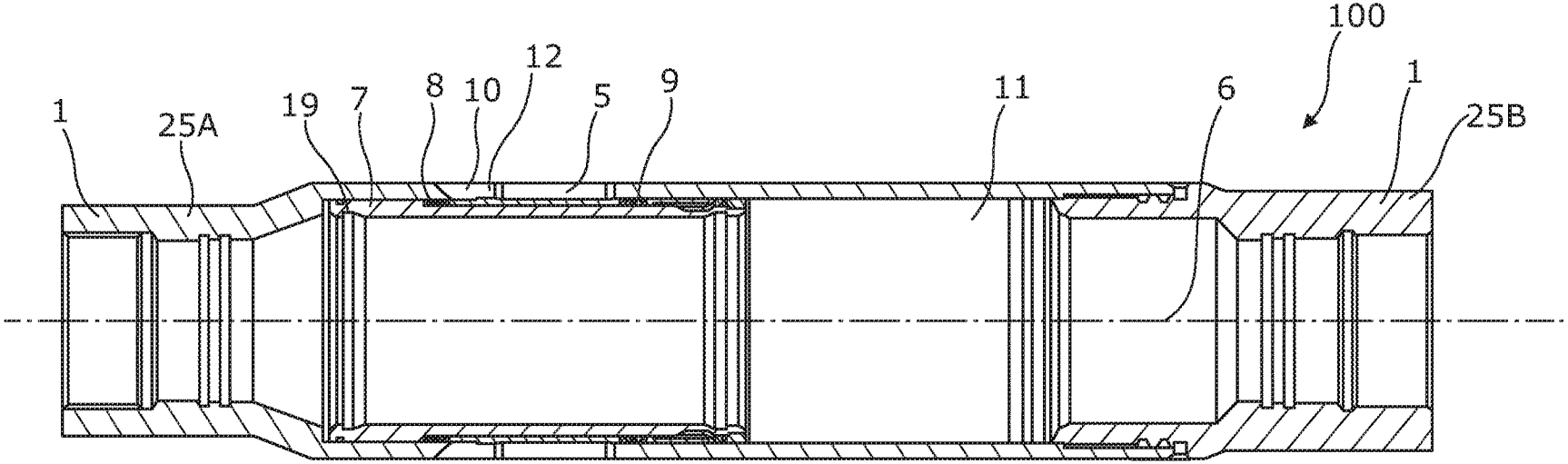
Figure 2B:
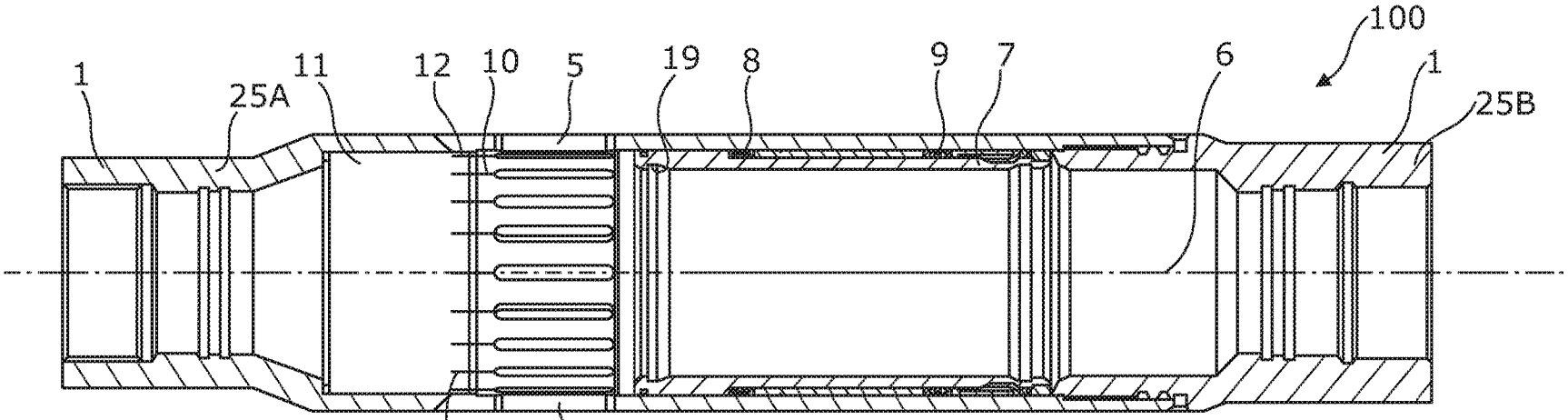
Figure 3:
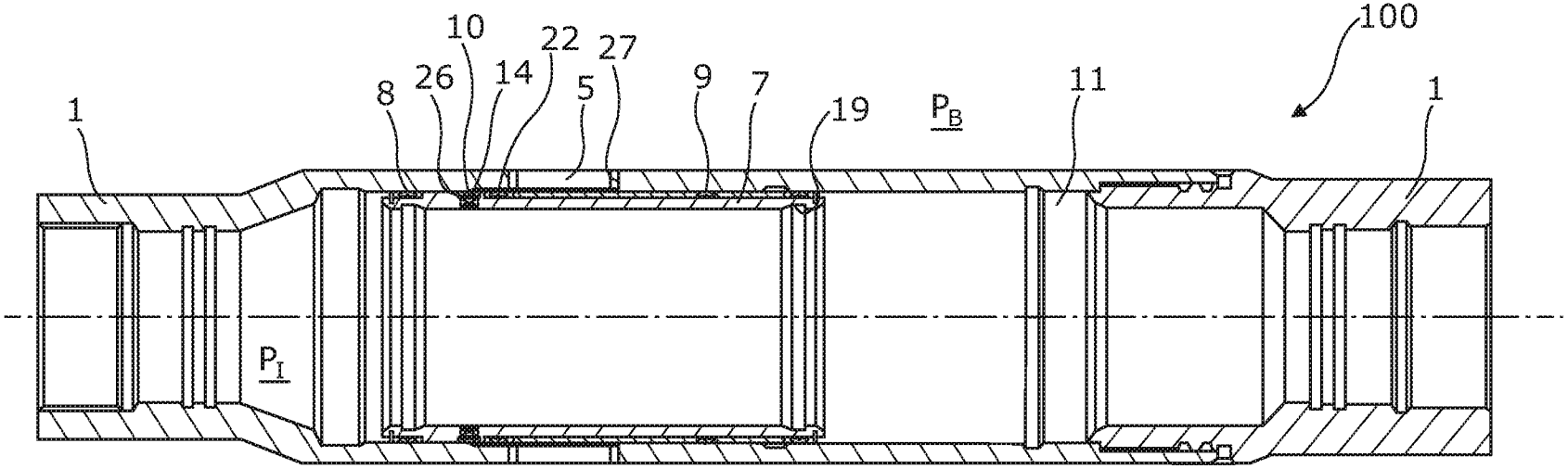
Figure 3A:
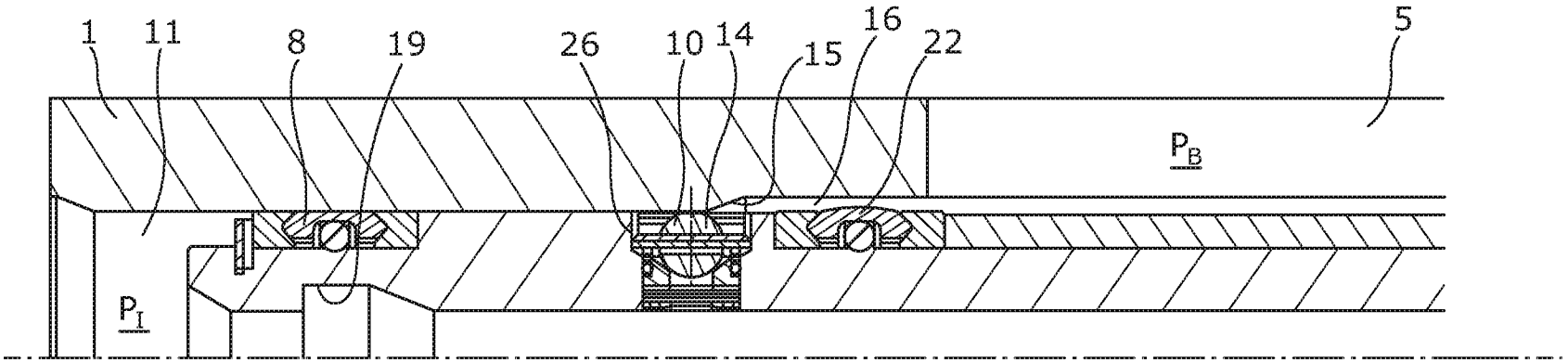
Figure 4:
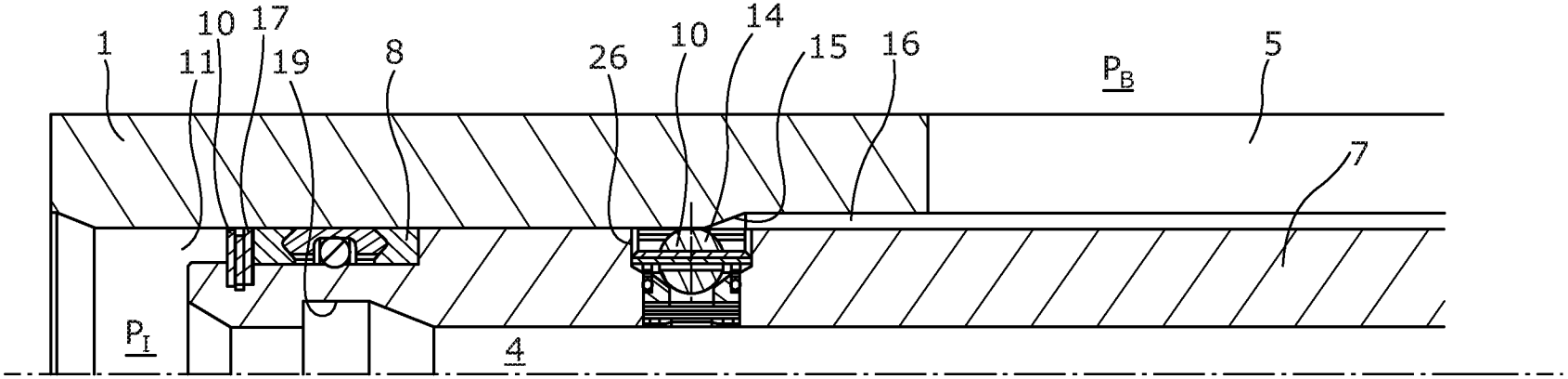
Figure 5:
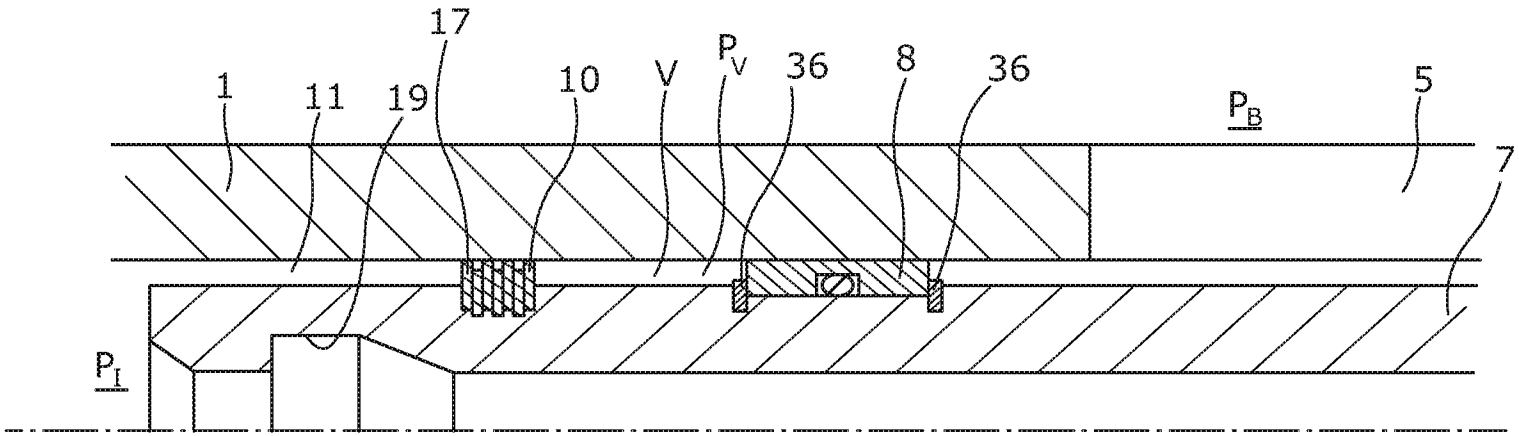
Figure 6:
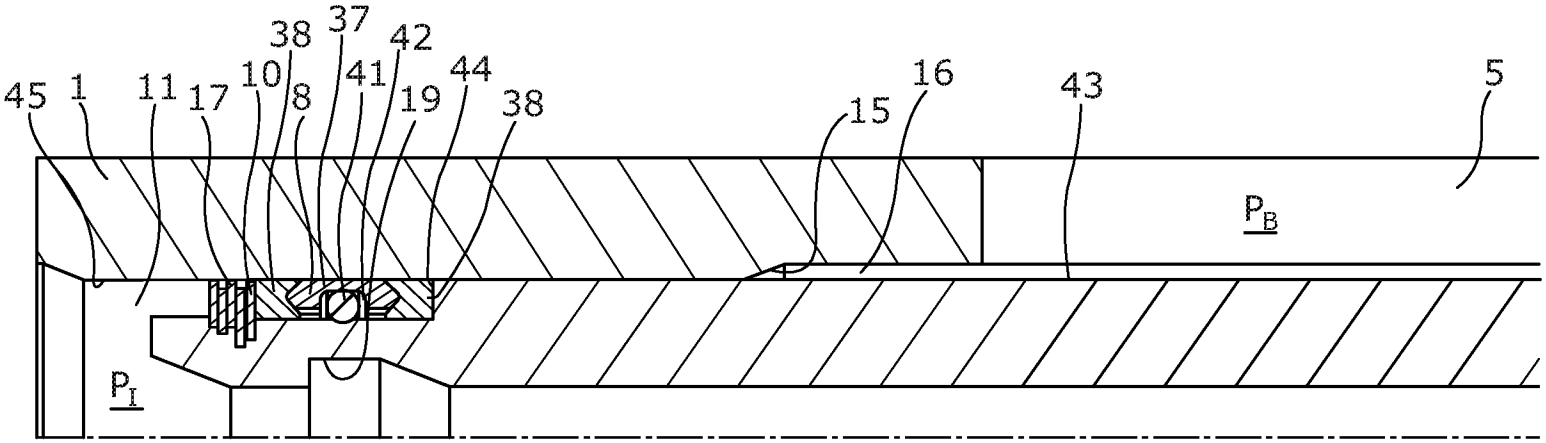
Figure 7:
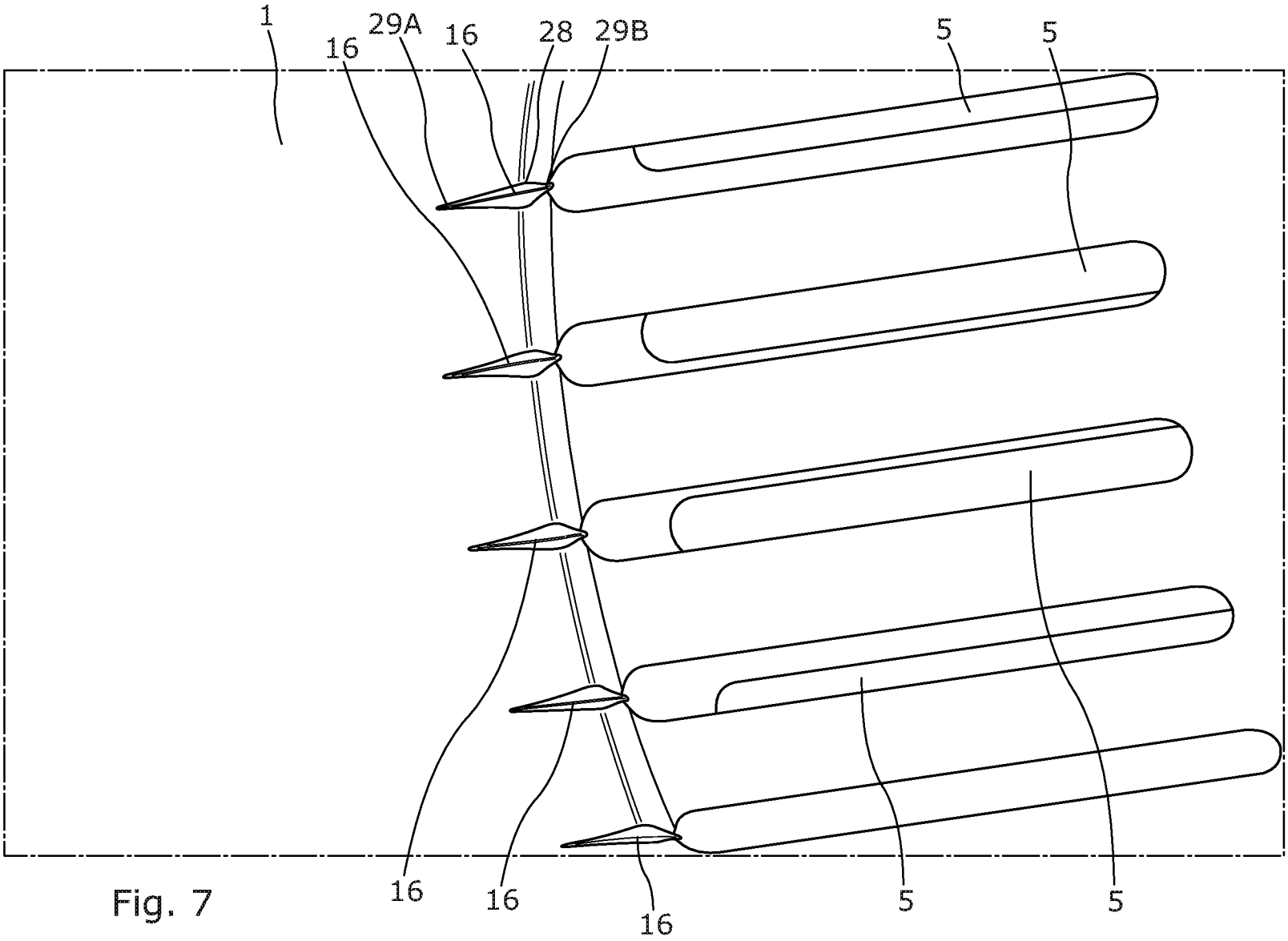
Figure 8:
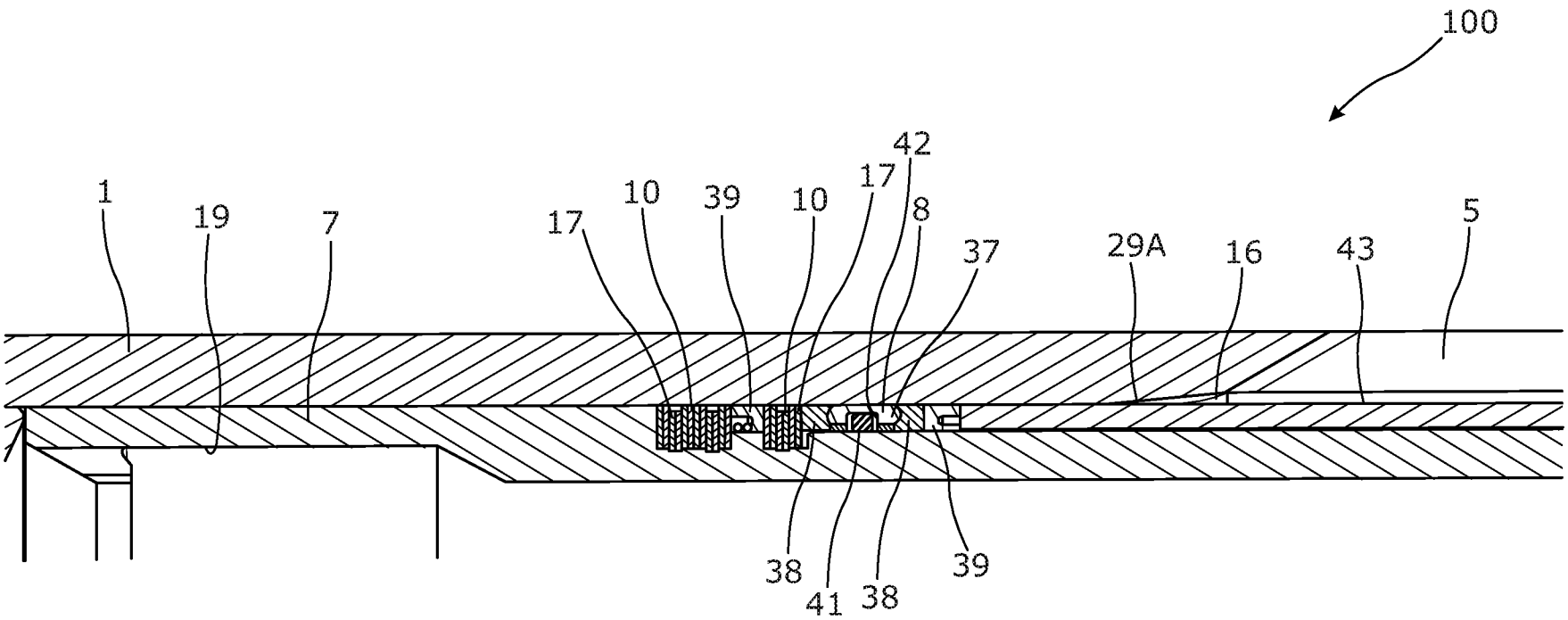

The invention and its many advantages will be described in more detail below with reference to the accompanying schematic drawings, which for the purpose of illustration show some non-limiting embodiments and in which FIG. 1 shows a partly cross-sectional view of a downhole system, FIG. 2A shows a cross-sectional view of a downhole system having a sliding sleeve in its first position, FIG. 2B shows the downhole system of FIG. 2A having a sliding sleeve in its second position, FIG. 3 shows a cross-sectional view of another downhole system having a sliding sleeve in its first position, FIG. 3A shows a cross-sectional view of part of the downhole system of FIG. 3, FIG. 4 shows a cross-sectional view of part of another downhole system, FIG. 5 shows a cross-sectional view of part of another downhole system, FIG. 6 shows a cross-sectional view of part of another downhole system, FIG. 7 shows a part of the well tubular metal structure having openings and sloping parts, and FIG. 8 shows a cross-sectional view of part of yet another downhole system.

All the figures are highly schematic and not necessarily to scale, and they show only those parts which are necessary in order to elucidate the invention, other parts being omitted or merely suggested.

FIG. 1 shows a downhole system 100 for completing a well 2 having a top 51 and a borehole 3 having a borehole pressure $P_B$. The downhole system 100 comprises a well tubular metal structure 1 comprising an inside 4 having an inside pressure $P_I$, an opening 5 and an axial extension 6. The downhole system 100 further comprises a sliding sleeve 7 movable along the axial extension. The sliding sleeve 7 is movable between a first position in which the sliding sleeve 7 seals off the opening, as shown in FIG. 2A, and a second position in which fluid communication between the borehole 3 and the inside of the well tubular metal structure 1 is allowed, as shown in FIG. 2B. The sliding sleeve 7 has an outer face 43 (shown in FIG. 6) and comprises a first sealing element 8 arranged on the outer face on one side of the opening 5 and a second sealing element 9 arranged on the outer face on the other side of the opening 5 in the first position, as shown in FIG. 2A. The first sealing element 8 and the second sealing element thus move along with the sliding sleeve when moving between the first and the second position along in the inner face 45 (shown in FIG. 6) of the well tubular metal structure. The downhole system 100 further comprises a pressure reducing mechanism 10, which is arranged adjacent the first sealing element 8 for reducing a pressure exerted on the first sealing element 8 while moving the sliding sleeve 7 from the first position to the second position. The first sealing element 8 is the sealing element moving past the opening. The second sealing element may not have the pressure reducing mechanism.

The downhole system 100 is especially useful when the inside pressure is substantially larger than the borehole pressure, such as when there is a risk of reaching/running through a very low pressure zone, also called experiencing loss of pressure. When the pressure in the borehole is so low then pressure difference across the seals of the sliding sleeve is very high. During the movement of the sliding sleeve from the first and closed position to the second and open position, there is a great risk that the sealing element passing the opening is damaged. This is especially the case when the pressure difference is very high as the sealing element is then very energised, i.e. being pushed radially outwards. This is due to the fact that when the first sealing element reaches the opening, the inside pressure, which is very high in relation to the borehole pressure, presses the first sealing element out into the opening, and when the first sealing element then reaches the edge on the other side of the opening, the sealing element is squeezed and damaged. Furthermore, when using an inner string for opening the sliding sleeve, the sliding sleeve 7 is moved with a high speed because of the compression force inherent in the inner string pushing from the top of the well and as the sliding sleeve 7 starts to move, the inner string starts to un-compress increasing the speed of the movement. An inner string may be compressed e.g. 40-50 cm when pressing onto the sliding sleeve 7 and as the sliding sleeve 7 starts to move, the compression force inherent in the inner string is released increasing the speed. By having a pressure reducing mechanism 10, the pressure across the first sealing element 8 is reduced before the sealing element reaches the opening, and the pressure exerted on the first sealing element is thus decreased and does not push the sealing element "out of shape", and the first sealing element is de-energised and moves past the opening in its relaxed condition so that the sealing element is not damaged when reaching the edge of the opening.

In FIG. 2A, the pressure reducing mechanism 10 is arranged between the opening 5 and the first sealing element 8 in the first position. The pressure reducing mechanism 10 is at least one slit 12 penetrating the well tubular metal structure 1 and extending in the axial extension 6 from the opening towards the first sealing element 8 in the first position. The pressure reducing mechanism 10 reduces the inside pressure exerted on the first sealing element 8 when the sliding sleeve 7 moves from the first position to the second position since when the first sealing element 8 passes the slit, the pressure in the well tubular metal structure 1 is equalized with the pressure in the borehole 3 in a venting manner and as more of the slit is exposed to the inside pressure, the equalizing increases. When the first sealing element 8 reaches the opening 5, the pressure in the well tubular metal structure 1 is almost equalized with the pressure in the borehole 3, and no force is exerted on the first sealing element, and the first sealing element 8 is not damaged due to the pressure difference. The slit forms part of the opening as a "tale" but may also be separate from the opening 5.

In FIG. 2B, the first sealing element 8 and the second sealing element 9 are arranged on the same side of the opening 5 in the second position. The well tubular metal structure 1 has a recess 11 in which the sliding sleeve 7 moves between the first position and the second position. The recess 11 is formed by two well tubular metal structure parts 25A, 25B which are screwed together into one well tubular metal structure 1.

In FIG. 3, the pressure reducing mechanism 10 comprises a check valve 14 arranged in a through-bore 26 of the sliding sleeve. The pressure reducing mechanism further comprises a sloping part 15, as shown in the enlarged view FIG. 3A, the sloping part 15 being provided in the well tubular metal structure 1 and in fluid communication with the opening 5. The check valve 14 moves from a closed position to an open position when reaching the sloping part 15, and when the sliding sleeve and the check valve move further, the check valve is opened allowing fluid from the inside to the borehole. The check valve 14 is shown in its closed position in FIG. 3A. As can be seen in FIG. 3A, the sloping part forms part of an indentation 16 or may also form part of a groove in the well tubular metal structure 1. The sliding sleeve 7 has a third sealing element 22 arranged between the pressure reducing mechanism 10 and the opening in the first position but in another embodiment shown in FIG. 4, the sliding sleeve does not have the third sealing element 22. The third sealing element 22 of FIG. 3A shows the relaxed condition of a sealing element which is not in the risk of being damaged when passing the opposing edge 27 (shown in FIG. 3) of the opening 5. The sealing elements are disclosed as chevron seals but may also be another suitable sealing element.

In FIG. 5, the first sealing element 8 is arranged between the pressure reducing mechanism 10 and the opening 5 when the sliding sleeve 7 is in the first position which arrangement creates an annular volume V between the well tubular metal structure 1, the sliding sleeve 7, the first sealing element 8 and the pressure reducing mechanism 10. The pressure reducing mechanism 10 is a labyrinth seal 17 which prevents the inside pressure $P_I$ in freely equalizing with the pressure $P_V$ inside the annular volume V since the fluid has to pass through the labyrinth. As the sliding sleeve 7 moves the first sealing in a position in which the first sealing element partly overlaps the opening, the volume pressure $P_V$ presses slightly onto the other side of the first sealing element 8, and the volume increases, but since the volume V is not directly equalized with the inside pressure, the volume pressure drops as a result of the increasing volume, and the pressure exerting onto the first sealing element is reduced accordingly to be significantly smaller than the inside pressure before the first sealing element passes the opening 5. The first sealing element 8 is held in place by means of snap rings 36.

FIG. 6 shows a cross-sectional view of part of the downhole system in FIG. 1 where the sliding sleeve 7 is movable inside the well tubular metal structure and along the axial extension between a first position, in which the sliding sleeve seals off the opening, and a second position, in which fluid communication between the borehole and the inside of the well tubular metal structure is allowed. The sliding sleeve has an outer face 43 having at least one groove 44, and the outer face faces an inner face 45 of the well tubular metal structure, the first sealing element 8 arranged in the groove on one side of the opening and the second sealing element 9 arranged on the other side of the opening in the first position. The first sealing element 8 is arranged between the pressure reducing mechanism 10 and the opening, and the pressure reducing mechanism 10 is a labyrinth seal 17 for reducing a pressure exerted on the first sealing element while moving the sliding sleeve from the first position to the second position. The sealing elements and the pressure reducing mechanism 10 are arranged on the sliding sleeve and slide along with the sliding sleeve. In this way, the sealing elements are not left behind being exposed to well fluid as they would be in prior art solutions, where the sealing elements are arranged in the well tubular metal structure and when the sliding sleeve moves and no longer holds them squeezed in place between the sliding sleeve and the well tubular metal structure. Furthermore, the sealing elements 8,9 of the present invention are arranged between the sliding sleeve and the well tubular structure also in the second position so that they are not exposed to well fluid during production and are more likely to function properly than the prior art solutions where the seals are in the stationary well tubular structure.

The first sealing element 8 of FIG. 6 comprises a first element part 37 and two second element parts 38, where the second element part 38 is made of a material more rigid than that of the first element part 37 so that the second element part is configured to wipe off the inner face of the well tubular structure when the sliding sleeve moves the first sealing element past the opening and into a position between the well tubular metal structure and the sliding sleeve.

The second element part 38 may be of polyetheretherketon (PEEK), and the first element part 37 may be of a polymer more ductiled than that of PEEK. The first element part 37 has an element groove 42 facing the outer face 43 of the sliding sleeve and forming a cavity therebetween. The first sealing element 8 further comprises a third element part 41 arranged in the element groove 42 configured to spring load or energize the third element part 41. The third element part 41 may be an o-ring or a material suitable for providing the spring loading or energising of the third element part 41.

Even though not shown in FIG. 6, the second sealing element 9 may have the same configuration as the first sealing element.

In FIG. 7, part of the well tubular metal structure is seen from within showing the openings 5 and the indentation 16 at the edge of the opening closest to the first sealing element when in the first position. The indentation 16 begins with a tapering part 29A and ends in a second part 29B and in between has a broader section 28. The tapering part 29 tapers from the middle section 28 away from the opening. When the first sealing element slides past the indentation 16, the sealing element first passes the tapering part 29A so that the pressure equalizing occurs more slowly than if the opening was not "prolonged" with the indentation. If the indentation is arranged on the sloping part, the tapering part 29 tapers from the middle section 28 away from the opening along the sloping part. The indentation may also be arranged without the sloping part in the inner face of the well tubular metal structure.

By having the labyrinth seal 17, the first sealing element 8 is not exposed to the full inside pressure and thus not exposed to the full pressure difference between the borehole pressure $P_B$ and the inside pressure $P_I$, but the inside pressure $P_I$ is restricted by the labyrinth seal. By having the labyrinth seal 17 and arranging the first sealing element between the labyrinth seal 17 and the opening 5 and the indentation, the first sealing element is not damaged when opening the sliding sleeve even when there is a high pressure difference between the borehole pressure $P_B$ and the inside pressure $P_I$. By further having the first sealing element 8 and the labyrinth seal arranged on the outer face of the sliding sleeve and moving along with the sliding sleeve, the first sealing element is arranged pressing against the outer face of the sliding sleeve. In prior art solutions where the seals are arranged in the inner face of the well tubular metal structure and when passing a groove in the outer face of the sliding sleeve, the seals bulge unintentionally inwards and are slightly off-set from their indented position and thus get damaged by moving past such groove. This is not the case with the present invention as the sealing elements are arranged stretching around the outer face of the sliding sleeve, and thus a pre-tension of the sealing elements is provided so that the sealing elements press on the outer face and do not become slightly misplaced when passing the indentation.

In FIG. 8, the first sealing element 8 comprises the first element part 37 and the second element parts 38, and the third element part 41 for energising the first element part 37. Furthermore, the first sealing element 8 comprises two fourth element parts 39 which are C-shaped so as to provide an even better seal, and the fourth element 39 closest to the opening 5 will also provide a wiping effect when the sealing element has passed the opening and is moved along the inner face of the well tubular metal structure on the other side of the opening. In between the other fourth element 39 and one of the second element parts 38, a second labyrinth seal 17 is provided so that the fluid is restricted twice before passing the first element part 37 and the second element parts 38.

As shown in FIG. 2B, the well tubular metal structure comprises more than one opening provided around the circumference of the well tubular metal structure 1. Even though not shown, the well tubular metal structure 1 comprises more than one opening provided at a distance from each other along the axial extension 11, a sliding sleeve 7 moving opposite each opening.

In FIG. 1, the downhole system 100 further comprises an engaging element 18 for engaging a profile 19 (shown in FIG. 3A) in the sliding sleeve 7 for moving the sliding sleeve 7 between the first position and the second position. The engaging elements 18 are parts of an intervention tool 20 but may also be part of an inner well tubular metal structure 21 if that is used to open or close the sliding sleeves.

The downhole system 100 further comprises three annular barriers 30, each having a tubular part 31 mounted as part of the well tubular metal structure 1. The tubular part 31 is surrounded by an expandable metal sleeve 32, which is expanded by means of pressurised fluid from the inside of the well tubular metal structure 1 through a valve assembly 34 into an annular space 35 between the tubular part and the expandable metal sleeve to abut the wall of the borehole as shown in the bottom part of the well tubular metal structure of FIG. 1 or to abut the upper well tubular metal structure as shown in the top of the well tubular metal structure 1. The first annular barrier and a second annular barrier abutting the wall of the borehole together isolates a production zone 101 between them, and when the sliding sleeve is in its second position, the reservoir fluid is allowed to flow into the well tubular metal structure 1 through the opening 5 and past the sliding sleeve and further up the inner string. The inner string may extend all the way to the bottom 54 of the well tubular metal structure 1. Even though not shown, the downhole system may further comprise a plurality of openings 5 arranged with a distance along the axial extension 6 and a plurality of sliding sleeves so that each sliding sleeve is arranged opposite one of the openings.

The intervention tool may comprise a stroking tool which is a tool providing an axial force. The stroking tool comprises an electrical motor for driving a pump. The pump pumps fluid into a piston housing to move a piston acting therein. The piston is arranged on the stroker shaft. The pump may pump fluid into the piston housing on one side and simultaneously suck fluid out on the other side of the piston.

By fluid, reservoir fluid or well fluid is meant any kind of fluid that may be present in oil or gas wells downhole, such as natural gas, oil, oil mud, crude oil, water etc. By gas is meant any kind of gas composition present in a well, completion or open hole, and by oil is meant any kind of oil composition, such as crude oil, an oil-containing fluid etc. Gas, oil and water fluids may thus all comprise other elements or substances than gas, oil, and/or water, respectively.

By a casing or well tubular metal structure is meant any kind of pipe, tubing, tubular, liner, string etc. used downhole in relation to oil or natural gas production.

In the event that the intervention tool is not submergible all the way into the casing, a downhole tractor can be used to push the tool all the way into position in the well. The downhole tractor may have projectable arms having wheels, wherein the wheels contact the inner surface of the casing for propelling the tractor and the tool forwards in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole system for completing a well, comprising:

a well tubular metal structure arranged in a borehole having a borehole pressure ($P_B$), the well tubular metal structure comprising an inner face and an inside having an inside pressure ($P_I$), an opening and an axial extension, and a sliding sleeve having an outer face and movable inside the well tubular metal structure and along the axial extension between a first position in which the sliding sleeve seals off the opening and a second position in which fluid communication between the borehole and the inside of the well tubular metal structure is allowed, the sliding sleeve comprising a first sealing element arranged on the outer face on one side of the opening and a second sealing element arranged on the outer face on the other side of the opening in the first position, wherein a pressure reducing mechanism is arranged in relation to the first sealing element for reducing a pressure exerted on the first sealing element while moving the sliding sleeve from the first position to the second position, wherein the pressure reducing mechanism is a labyrinth seal; and wherein the pressure reducing mechanism is at least one slit penetrating the well tubular metal structure and extending in the axial extension from the opening towards the first sealing element in the first position.

2. The downhole system according to claim 1, wherein the sliding sleeve has the outer face having at least two grooves and facing the inner face of the well tubular metal structure, the first sealing element is arranged in one of the grooves and the second sealing element is arranged in the other of the grooves.

3. The downhole system according to claim 1, wherein an inner diameter of the sealing elements is less than an outer diameter of a part of the outer face of the sliding sleeve so as to provide the sealing elements with a pre-tension when arranged on that part of the outer face.

4. The downhole system according to claim 1, wherein a sloping part forms part of an indentation or groove in the well tubular metal structure.

5. The downhole system according to claim 4, wherein the indentation or groove ends in the opening.

6. The downhole system according to claim 5, wherein the indentation or groove has a tapering part furthest away from the opening.

7. The downhole system according to claim 4, wherein the pressure reducing mechanism comprises a check valve arranged in the sliding sleeve, and a sloping part being provided in the well tubular metal structure and being in fluid communication with the opening so that the check valve moves from a closed position to an open position when the check valve is opposite the sloping part allowing fluid from the inside to the borehole.

8. The downhole system according to claim 1, wherein the well tubular metal structure has a recess in which the sliding sleeve moves between the first position and the second position.

9. The downhole system according to claim 1, wherein the pressure reducing mechanism is arranged between the opening and the first sealing element in the first position.

10. The downhole system according to claim 1, wherein at least the first sealing element comprises a first element part and a second element part, where the second element part is made of a material more rigid than that of the first element part.

11. The downhole system according to claim 1, wherein the sliding sleeve comprises a second labyrinth seal.

12. The downhole system according to claim 1, wherein the first sealing element is arranged between the pressure reducing mechanism, the opening and the opening in the first position which creates an annular volume (V) between the well tubular metal structure, the sliding sleeve, the first sealing element and the pressure reducing mechanism.

13. The downhole system according to claim 1, further comprising an engaging element for engaging a profile in the sliding sleeve and for moving the sliding sleeve between the first position and the second position, the engaging elements being parts of an intervention tool or an inner well tubular metal structure.

14. The downhole system according to claim 13, further comprising a first annular barrier and a second annular barrier together isolating a production zone between them.

15. The downhole system according to claim 1, further comprising a third sealing element arranged between the pressure reducing mechanism and the opening in the first position.

16. The downhole system according to claim 15, wherein the opening and the sliding sleeve are arranged opposite the production zone.

17. The downhole system according to claim 1, further comprising an annular barrier having a tubular part to be mounted as part of the well tubular metal structure, the tubular part is surrounded by an expandable metal sleeve, the expandable metal sleeve is configured to be expanded by means of pressurised fluid from the inside of the well tubular metal structure through a valve assembly into an annular space between the tubular part and the expandable metal sleeve.

18. The downhole system according to claim 1, further comprising a plurality of openings arranged with a distance along the axial extension and a plurality of sliding sleeves, each sliding sleeve arranged opposite one of the openings.

* * * * *